US011021340B2

(12) United States Patent
Kishimoto

(10) Patent No.: US 11,021,340 B2
(45) Date of Patent: Jun. 1, 2021

(54) SHEET STACKING DEVICE INCLUDING TURNABLE ANTI-SLIP STOPPER AND POST-PROCESSING DEVICE

(71) Applicant: KYOCERA Document Solutions Inc., Osaka (JP)

(72) Inventor: Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/795,135

(22) Filed: Feb. 19, 2020

(65) Prior Publication Data

US 2020/0262671 A1 Aug. 20, 2020

(30) Foreign Application Priority Data

Feb. 20, 2019 (JP) ..... JP2019-028480

(51) Int. Cl.
*B65H 31/02* (2006.01)
*B65H 37/06* (2006.01)
*B65H 37/04* (2006.01)

(52) U.S. Cl.
CPC ..... *B65H 31/02* (2013.01); *B65H 37/04* (2013.01); *B65H 37/06* (2013.01)

(58) Field of Classification Search
CPC ..... B65H 31/02; B65H 37/06; B65H 37/04; B65H 31/26; B65H 31/28; B65H 31/10; B65H 31/30; B65H 31/36; B65H 29/22; B65H 31/06; B65H 45/04; B65H 2405/1117; B65H 2405/11172; B65H 2405/1134; B65H 23/048; B65H 45/12; B65H 2405/10; B65H 45/142; B65H 45/18
See application file for complete search history.

(56) References Cited

U.S. PATENT DOCUMENTS 4,605,211 A * 8/1986 Sonobe ..... B65H 31/34 227/100
8,167,294 B2 * 5/2012 Yahata ..... B65H 31/36 270/58.27
8,177,213 B2 * 5/2012 Hirabayashi ..... B41J 13/106 270/58.07

(Continued)

FOREIGN PATENT DOCUMENTS

JP 2011-006175 A 1/2011
JP 2011006175 A * 1/2011

*Primary Examiner* — Patrick H Mackey
(74) *Attorney, Agent, or Firm* — Studebaker & Brackett PC

(57) ABSTRACT

A sheet stacking device includes a conveyance part and a stopper. The conveyance part includes a tray and a conveyance member. On the tray, sheet stacks are stacked. The conveyance member conveys the sheet stack on the tray. The stopper is located on a downstream side of the tray and prevents the sheet stack from falling from the tray. The stopper has a main plate and an anti-slip member. The main plate is inclined upward. The main plate has a contact face coming into contact with the sheet stack and a bent face bent downward from a downstream side tip end of the contact face. The anti-slip member is provided from a downstream side end portion of the contact face to the bent face. A frictional coefficient between the anti-slip member and the sheet stack is larger than a frictional coefficient between the sheet stack and the contact face.

10 Claims, 8 Drawing Sheets

(56) References Cited

U.S. PATENT DOCUMENTS

| | | | | |
|---|---|---|---|---|
| 8,616,542 | B2 * | 12/2013 | Min | B65H 31/28 270/45 |
| 8,931,773 | B2 * | 1/2015 | Sugiyama | B65H 29/6609 270/32 |
| 9,630,788 | B2 * | 4/2017 | Horita | B65H 85/00 |
| 9,896,296 | B2 * | 2/2018 | Chikamoto | B65H 31/24 |
| 10,150,637 | B2 * | 12/2018 | Wakayama | B65H 37/04 |
| 10,737,897 | B2 * | 8/2020 | Kondo | B65H 29/38 |

* cited by examiner

SHEET STACKING DEVICE INCLUDING TURNABLE ANTI-SLIP STOPPER AND POST-PROCESSING DEVICE

INCORPORATION BY REFERENCE

This application is based on and claims the benefit of priority from Japanese Patent application No. 2019-028480 filed on Feb. 20, 2019, which is incorporated by reference in its entirety.

BACKGROUND

The present disclosure relates to a sheet stacking device which conveys the sheet stacks and stacks them and a post-processing device including the sheet stacking device.

In an operation for bookbinding booklets, a post-processing device for binding the sheet stack and then folding it is sometimes used. Such a post-processing device is provided with a sheet stacking device which conveys the folded sheet stacks (a booklet) and then stacks them. The sheet stacking device includes a tray on which the sheet stacks are stacked, a conveyance belt provided in the tray to convey the sheet stacks in the conveyance direction, and a stopper provided at the downstream end of the tray in the conveyance direction.

The stopper is provided so as to be movable in a position where the sheet stacks are inhibited from being conveyed and in another position where the sheet stacks are not inhibited from being conveyed. When the number of the sheet stacks is small, the stopper is moved to the sheet conveyance inhibiting position and allows the sheet stacks to be stacked. In this case, if the conveyance force of the conveyance belt is excessive, the sheet stacks inhibited from being conveyed may collapse.

Therefore, a conveyance force decreasing part may be provided, which decreases the conveyance force of the conveyance belt when the stopper is moved to the sheet conveyance inhibiting position.

However, if the stopper is moved to the sheet conveyance inhibiting position, in a case where the sheet stacks are continuously conveyed, there is a possibility that the sheet stack discharged earlier is pushed by the sheet stack discharged later and falls from the stopper.

SUMMARY

In accordance with an aspect of the present disclosure, a sheet stacking device includes a conveyance part and a stopper. The conveyance part includes a tray and a conveyance member. On the tray, sheet stacks discharged from a discharge part at predetermined time intervals are stacked. The conveyance member conveys the sheet stack on the tray along a predetermined conveyance direction. The stopper is located on a downstream side of the tray in the conveyance direction and prevents the sheet stack from falling from the tray. The stopper has a main plate and at least one anti-slip member. The main plate is inclined upward toward the downstream side with respect to the tray. The main plate has a contact face coming into contact with the sheet stack and a bent face bent downward from a tip end on the downstream side of the contact face so as to retract from the contact face. The at least one anti-slip member is provided from a downstream side end portion of the contact face to the bent face. A frictional coefficient between the anti-slip member and the sheet stack is larger than a frictional coefficient between the sheet stack and the contact face.

In accordance with an aspect of the present disclosure, a post-processing device includes a binding part binding a sheet stack, a folding part folding the sheet stack bound by the binding part and the sheet stacking device on which the sheet stack folded by the folding part is stacked.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a post-processing device according to one embodiment of the present disclosure will be described.

Figure 1:
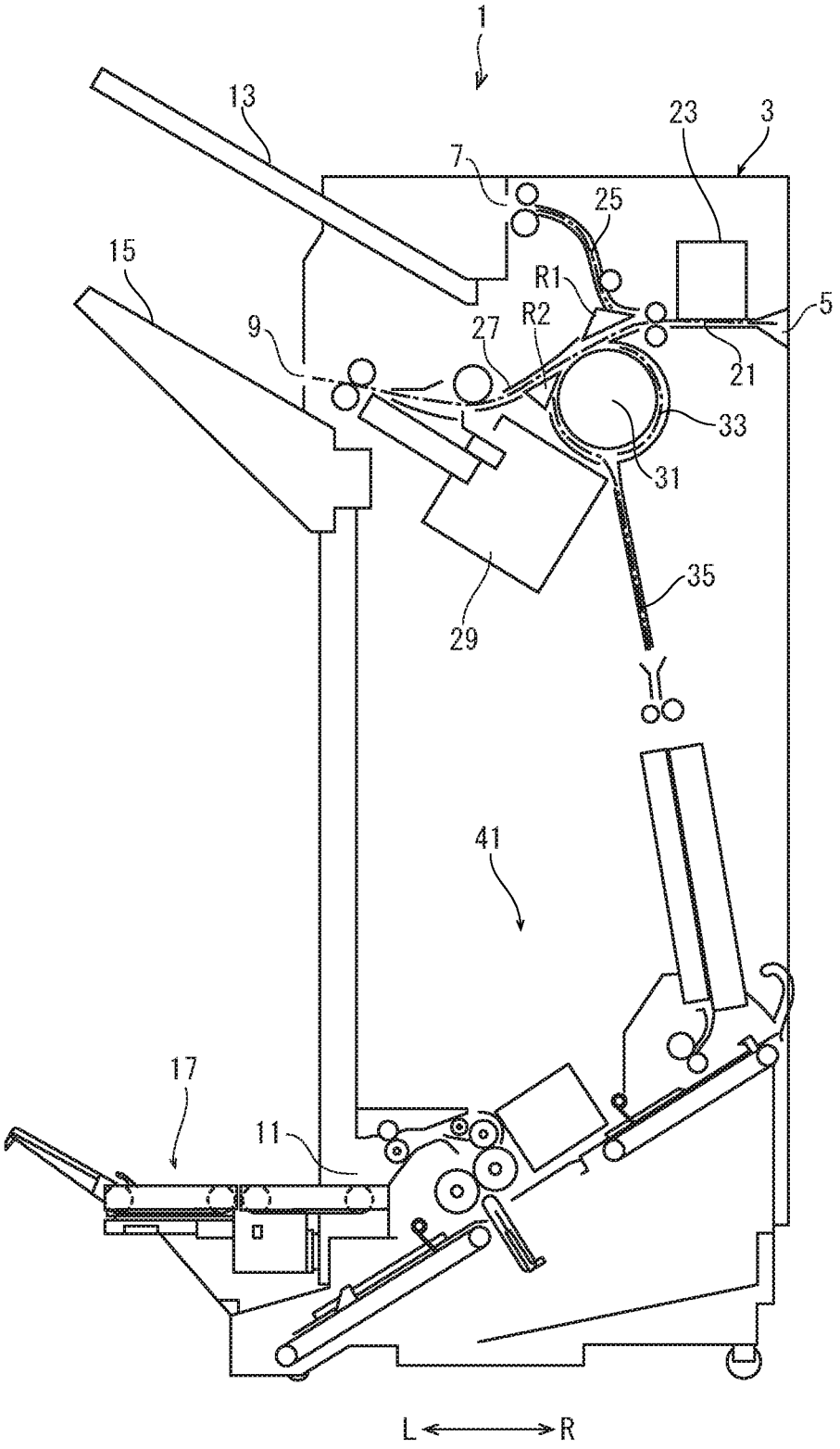
FIG. 1 is a front view schematically showing a post-processing device according to one embodiment of the present disclosure.

Firstly, with reference to FIG. 1, an entire structure of the post-processing device will be described. FIG. 1 is a front view schematically showing the entire structure of the post-processing device. In the following description, a near side of a paper surface of FIG. 1 is defined to be a front side of the post-processing device. Fr, Rr, L and R shown in each figure respectively indicate a front side, a rear side, a left side and a right side of the post-processing device.

The post-processing device 1 has a main body 3. On an upper portion of one side face (a right side face) of the main body 3, a sheet receiving port 5 is formed. On the other face (a left side face) of the main body 3, a first discharge port 7, a second discharge port 9 and a third discharge port 11 are formed in the order from the upper side. Below the first discharge port 7, a first discharge tray 13 is provided, below the second discharge port 9, a second discharge tray 15 is provided and below the third discharge port 11, a sheet stacking device 17 (described later in detail) is provided.

Inside the main body 3, a conveyance path 21 for the sheet is provided such that the sheet is conveyed in a conveyance direction from the sheet receiving port 5 toward the inside of the main body 3. On the conveyance path 21, a punching device 23 is provided. The punching device 23 opens a punch hole on the sheet.

The conveyance path 21 is branched at a first branch point R1 downstream the punching device 23 into a first branch path 25 and a second branch path 27. The first branch path 25 extends from the first branch point R1 toward the first discharge port 7. The second branch path 27 extends from the first branch point R1 toward the second discharge port 9. On the second branch path 27, a staple device 29 is provided. The staple device 29 binds a sheet stack using a staple.

The second branch path 27 is branched at a second branch point R2 downstream the first branch point R1 into a third branch path 35 via a waiting path 33. The waiting path 33 is formed around a waiting drum 31 which holds the sheet temporarily. The third branch path 35 extends downward. Below the third branch path 35, a folding device 41 which folds the sheet stack is provided.

Figure 2:
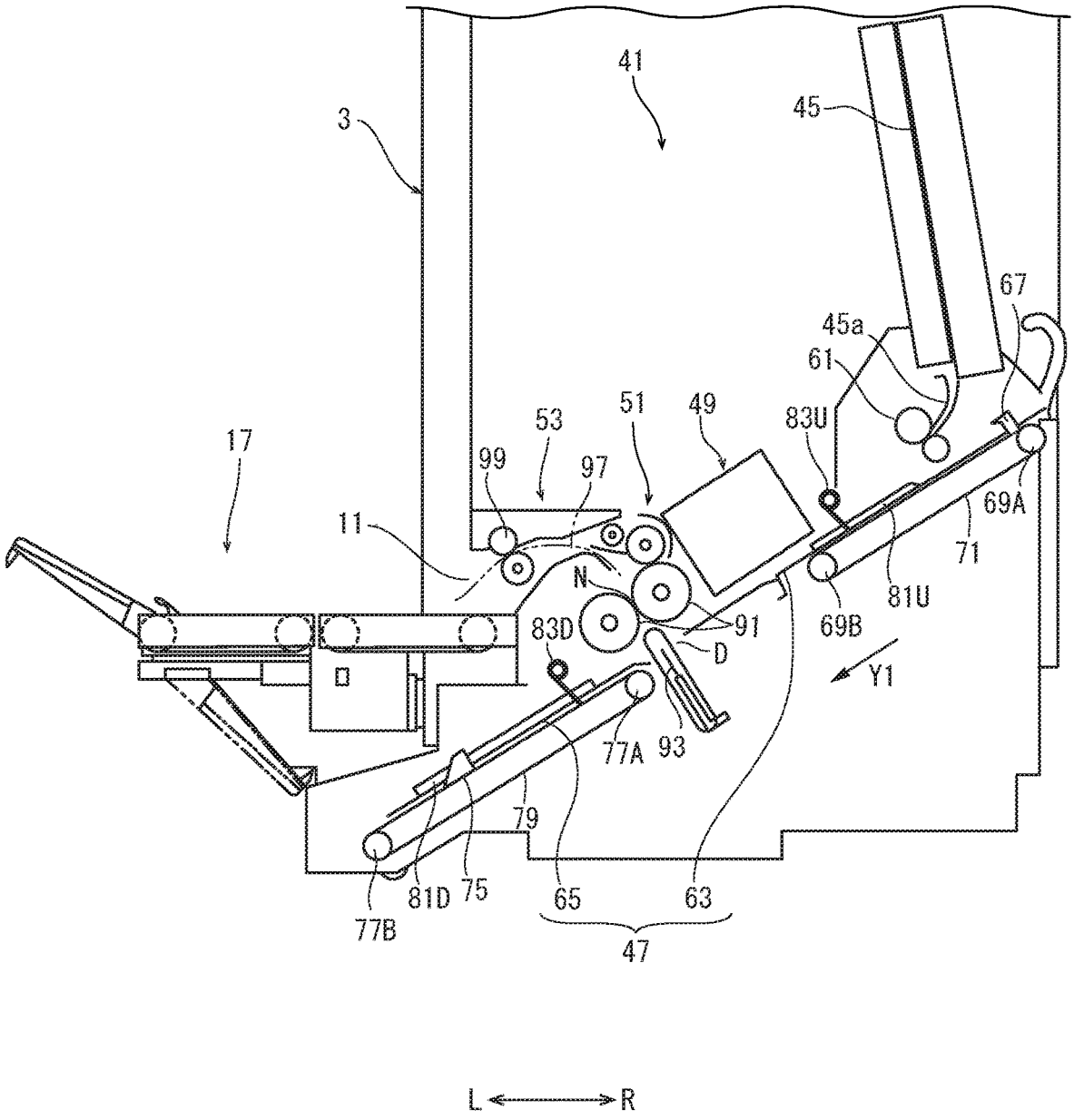
FIG. 2 is a front view schematically showing a folding device according to the embodiment of the present disclosure.
Figure 3:
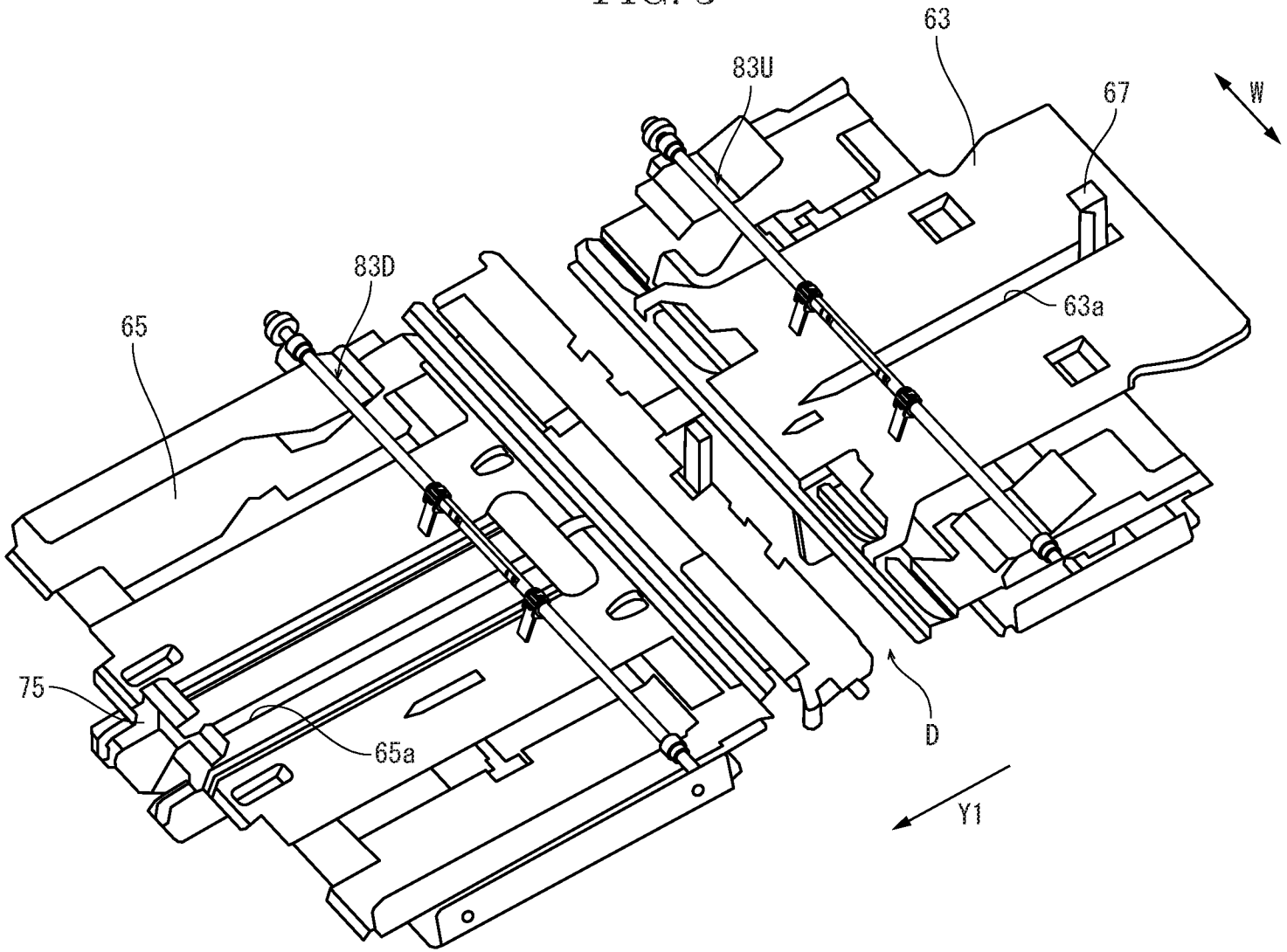
FIG. 3 is a perspective view showing a processing tray of the folding device, in the post-processing device according to the embodiment of the present disclosure.

Next, the folding device 41 will be described with reference to FIG. 2 and FIG. 3. FIG. 2 is a front view schematically showing the folding device and FIG. 3 is a perspective view showing a processing tray of the folding device.

The folding device 41 includes a carrying path 45 along the upper-and-lower direction, a processing tray 47 disposed below the carrying path 45, a binding part 49 and a folding part 51 supported by the processing tray 47 and a discharge part 53 formed between the folding part 51 and the third discharge port 11.

The carrying path 45 is formed so as to extend downward from the exit of the third branch path 35. The lower end portion 45*a* of the carrying path 45 is inclined in an oblique left lower direction. A carrying rollers pair 61 is disposed at the exit of the lower end portion 45*a*. The carrying rollers pair 61 includes a drive roller driven by a drive source (not shown) to be rotated and a driven roller driven by the drive roller to be rotated. The carrying rollers pair 61 feeds the sheet carried in the carrying path 45 from the carrying path 45 obliquely downward along the oblique direction of the lower end portion 45*a*. In the following description, the direction in which the sheet is fed out by the carrying rollers pair 61 is referred to a conveyance direction Y1.

The processing tray 47 includes an upstream side tray 63 disposed upstream in the conveyance direction Y1 and a downstream side tray 65 disposed downstream of the upstream side tray 63 at a predetermined interval D. The upstream side tray 63 and the downstream side tray 65 are disposed so as to be inclined downward along the conveyance direction Y1. As shown in FIG. 3, the upstream side tray 63 and the downstream side dray 65 respectively have slits 63*a* and 65*a* formed along the conveyance direction Y1 in the center portions in a width direction perpendicular to the conveyance direction Y1.

On the upstream side tray 63, an upstream side cursor 67 is supported in a slidable manner along the conveyance direction Y1 and the counter direction. Below the upstream side end and the downstream side end of the upstream side tray 63 in the conveyance direction Y1, pulleys 69A and 69B are respectively supported in a rotatable manner. Around the pullers 69A and 69B, an endless belt 71 is wound. The upstream side cursor 67 is mounted to the endless belt 71, and protrudes upward from the upstream side tray 63 through the slit 63*a*. When the pullies 69A and 69B are rotated to circulate the endless belt 71, the upstream side cursor 67 is moved along the slit 63*a*.

On the downstream side tray 65, a downstream side cursor 75 is supported in a slidable manner along the conveyance direction Y1 and the counter direction. Below the upstream side end and the downstream side end of the downstream side tray 65 in the conveyance direction Y, pulleys 77A and 77B are respectively supported in a rotatable manner. Around the pullers 77A and 77B, an endless belt 79 is wound. The downstream side cursor 75 is mounted to the endless belt 79, and protrudes upward from the downstream side tray 65 through the slit 65*a*. When the pullies 77A and 77B are rotated to circulate the endless belt 79, the downstream side cursor 75 is moved along the slit 65*a*.

Additionally, on the upstream side tray 63 and the downstream side tray 65, two pairs of width alignment members 81U and 81D are respectively supported in a movable manner along the with direction. Furthermore, above the upstream side tray 63 and the downstream side tray 65, two conveyance members 83U and 83D are respectively supported in a rotatable manner.

The biding part 49 is a stapler which binds the center portion of the sheet stack, and is disposed above the upstream side tray 63.

The folding part 51 includes a pair of folding rollers 91 and a folding blade 93 capable of advancing and retracting into and from a nip N between the folding rollers 91. The pair of folding rollers 91 is disposed along the width direction above the interval D between the upstream side tray 63 and the downstream side tray 65. The upstream side folding roller 91 is driven by a drive source (not shown) to be rotated in the clockwise direction in FIG. 2. The downstream side folding roller 91 is biased by a biasing member (not shown) to press against the upstream side folding roller 91. The folding blade 93 is driven by a drive mechanism (not shown) to advance and retract through the interval D into and from the nip N between the folding rollers 91.

The discharge part 53 includes a discharge path 97 and a discharge roller 99. The discharge path 97 extends from the exit of the nip N between the folding rollers of the folding part 51 toward the third discharge port 11. The discharge roller 99 is supported at the exit of the discharge path 97 in a rotatable manner.

Next, the sheet stacking device 17 will be described with reference to FIG. 4. The sheet stacking device 17 is formed protruding leftward from the left side face of the main body 3 below the third discharge port 11. The sheet stacking device 17 includes a conveyance part 101 and a stopper 103. The conveyance part 101 conveys the sheet stack discharged through the third discharge port 11, that is, the booklet produced by the folding device 41, leftward. In this example, the conveyance direction Y2 of the booklet by the conveyance part 101 is the left direction along an approximately horizontal direction.

The conveyance part 101 includes an upstream side conveyance mechanism 107 and a downstream side conveyance mechanism 109 which are disposed in the order along the conveyance direction Y2. Each of the conveyance mechanisms 107 and 109 includes a tray 111, a drive roller 113, a driven roller 115, and two endless belts 117 as a conveyance member.

The tray 111 has two grooves formed along the conveyance direction Y2 at an interval in the width direction. The drive roller 113 and the driven roller 115 are respectively disposed below the upstream side end portion and the downstream side end portion of the tray 111 in a rotating manner. The two endless belts 117 are disposed in the two grooves of the tray 111, and wound around the drive roller 113 and the driven roller 115. The upper traveling faces of the endless belts 117 wound around the rollers 113 and 115 are set to be almost the same height as the upper face of the tray 111.

When the drive roller 113 is rotated to circulate the endless belts 117, the booklet is conveyed on the upper face of the tray 111 in the conveyance direction Y2. Then, the booklet discharged through the third discharge port 11 and fallen on the upstream side conveyance mechanism 107 is conveyed from the upstream side conveyance mechanism 107 to the downstream side conveyance mechanism 109 along the conveyance direction Y2.

The tray 111 of the downstream side conveyance mechanism 109 is provided with an actuator 119 as a detection part. The actuator 119 is disposed in the downstream side end of the tray 111, and turnable between a protruding position where the actuator 119 protrudes from the upper face of the tray 111 and a retracting position where the actuator 119 is retracted from the upper face of the tray 111. When the actuator 119 is pushed down by the sheet stack conveyed along the tray 111, it is turned from the protruding position to the retracting position. When the actuator 119 is turned, it is detected that the sheet stack is conveyed to a predetermined position.

Figure 5:
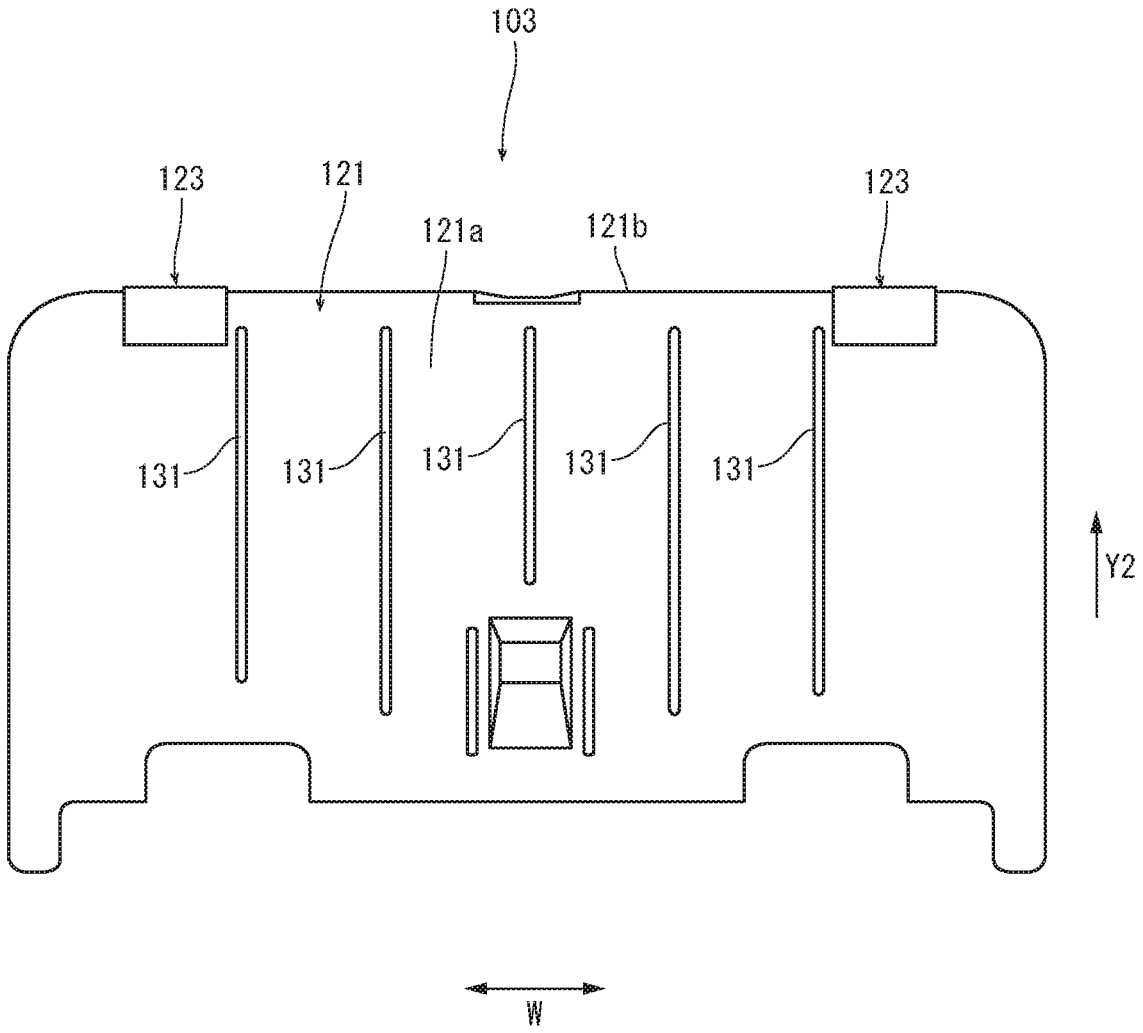
FIG. 5 is a plan view swing a stopper, in the post-processing device according to the embodiment of the present disclosure.
Figure 6:
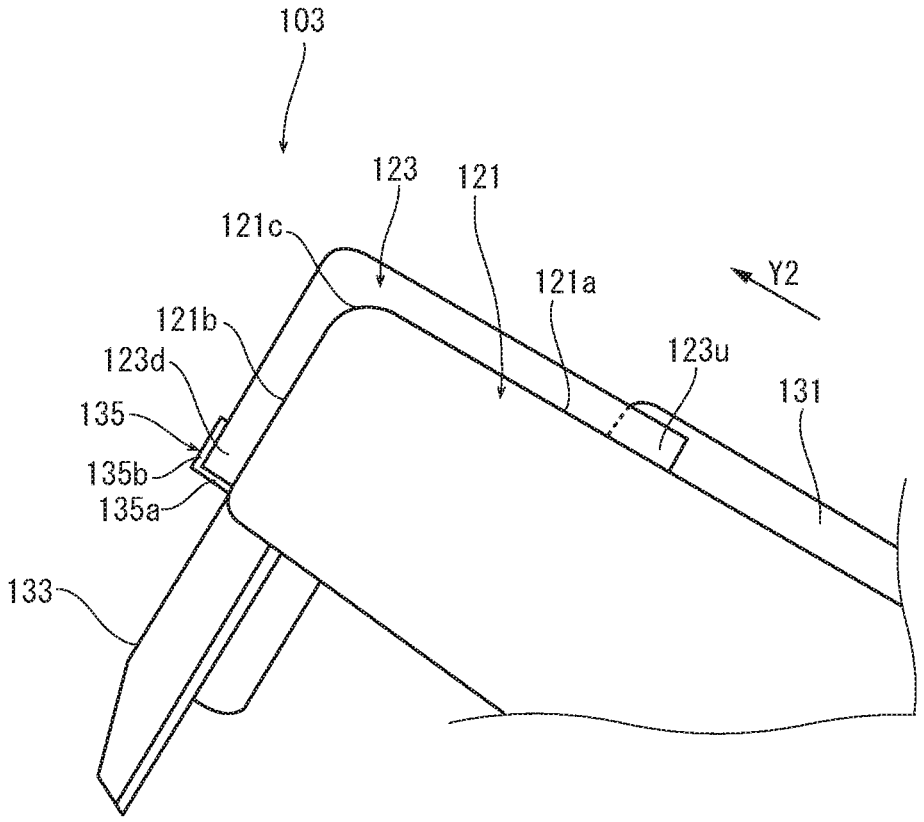
FIG. 6 is a front view showing the downstream side end portion of the stopper, in the post-processing device according to the embodiment of the present disclosure.

Next, the stopper 103 will be described with reference to FIG. 5 and FIG. 6. FIG. 5 is a plan view showing the stopper 103 and FIG. 6 is a front view showing the downstream side end portion of the stopper 103.

The stopper 103 has a main plate 121 and two anti-slip members 123 adhered to the main plate 121.

The main plate 121 has a rectangular plan shape long in the width direction W, and has a contact face 121*a* and a bent face 121*b* (a left side face) bent downward (in a direction retracting from the contact face 121*a*) from the downstream side end of the contact face 121*a* in the conveyance direction Y2. On the contact face 121*a*, a plurality of ribs 131 is protruded along the conveyance direction Y2. The downstream side ends of the ribs 131 do not reach the downstream side end (the upper end) of the contact face 121*a*.

Figure 4:
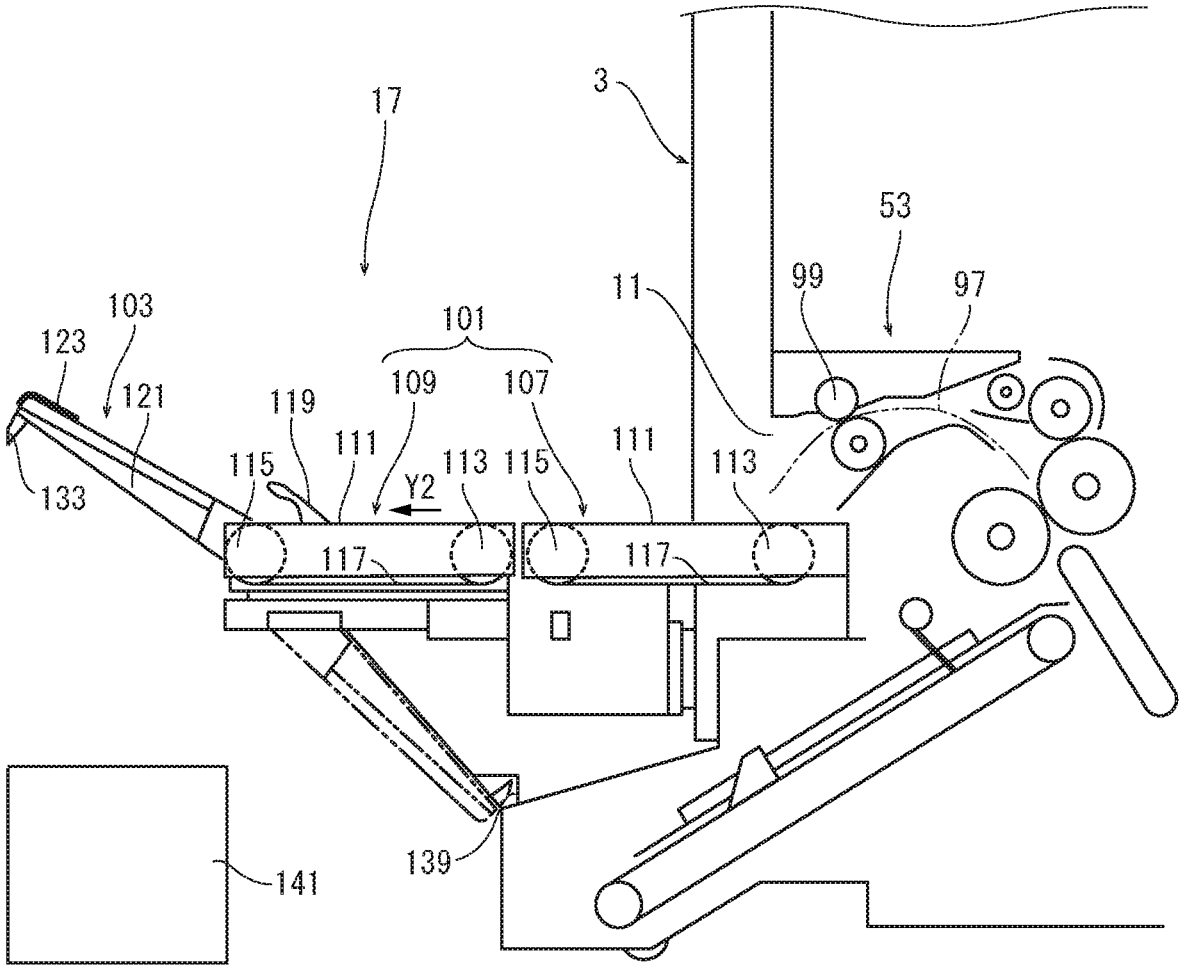
FIG. 4 is a front view schematically showing a sheet stacking device, in the post-processing device according to the embodiment of the present disclosure.

As shown in FIG. 4, on the downstream side end portion of the lower face of the main plate 121, a hook 133 is protruded downward in almost the center portion in the width direction W. Furthermore, on the bent face 121*b* of the main plate 121, two cover parts 135 are formed at a predetermined interval in the width direction W. As shown in FIG. 6, each cover part 135 has a base portion 135*a* and a tip portion 135*b*. The base portion 135*a* is stood almost perpendicularly to the bent face 121*b*. The tip portion 135*b* is bent upward from the tip end of the base portion 135*a* at almost right angles to the base portion 135*a*.

As shown in FIG. 4, the main plate 121 is supported by the downstream side end portion of the tray 111 of the downstream side conveyance mechanism 109 in a turnable manner between a restricting position and a retracting position. In the restricting position shown by a solid line in FIG. 2, the main plate 121 is inclined upward toward the downstream side in the discharge direction Y2 such that the conveyance of the booklet by the conveyance part 101 is restricted to prevent the booklet from falling from the tray 111. In the restricting position, the contact face 121*a* of the main plate 121 is smoothly continued from the upper face of the tray 111 of the downstream side conveyance mechanism 109. In the retracting position shown by a two-dotted chain line in FIG. 2, the main plate 121 is retracted from the upper face of the tray 111 of the downstream side conveyance mechanism 109, turned downward below the conveyance part 101, and the hook 133 is inserted into an opening 139 of the main body 3. The main plate 121 is held in the restricting position and the retracting position by the respective engagement means (not shown).

The anti-slip member 123 is a rectangular sheet like member long in the conveyance direction Y2. The anti-slip members 123 are disposed outside the ribs 131 at a predetermined interval in the width direction W, and adhered on the upper corner portion of the main plate 121. In detail, the anti-slip member 123 is adhered to cover the contact face 121*a* except the ribs 131, the bent face 121*b* and a corner 121*c* between the contact face 121*a* and the bent face 121*b*. The upstream side end portions 123*u* of the anti-slip members 123 are disposed upstream the downstream side end portions of the ribs 131. The downstream side end portions 123*d* of the anti-slip members 123 are stored in the cover parts 135. In detail, the end face and the outer face of the downstream side end portion 123*d* is respectively covered with the base portion 135*a* and the tip portion 135*b* of the cover part 135. The number of the anti-slip member 123 is not limited to two, and may be one, or three or more.

The anti-slip member 123 is made of felt, for example, and adhered on the main plate 121 with an adhesive or a double-side adhesive tape. Alternatively, the anti-slip member 123 may be made of anti-slip sheet with an adhesive face. The anti-slip member 123 has a thickness thinner than a height of the ribs 131. That is, the upper faces of the anti-slip members 123 are lower than the upper faces of the ribs 131. Additionally, a frictional force (a frictional coefficient) between the anti-slip member 123 and the booklet is larger than a frictional force between the main plate 121 (the contact face 121*a*) and the booklet. Furthermore, a frictional force between the anti-slip member 123 and the booklet is larger than a frictional force between the booklets.

Next, an operation for producing a booklet by using the folding device 41 having the above configuration will be described with reference to FIG. 2 mainly. In an initial state, the downstream side cursor 75 is moved to the receiving position downstream the conveying member 83D. The upstream side cursor 67 is moved upstream the carrying rollers pair 61. The width alignment members 81U and 81D are moved to a waiting position outside both the side edges of the sheet in the width direction.

When the sheet is conveyed into the carrying path 45 from the third branch path 35, the carrying rollers pair 61 is rotated to feed the first sheet from the lower end portion 45*a* of the carrying path 45 to the processing tray 47. The fed first sheet is slid on the processing tray 47 toward the downstream side cursor 75. At this time, the conveying members 83U and 83D are rotated to assists the conveyance of the first sheet on the processing tray 47. The first sheet is conveyed until the leading edge of the first sheet comes into contact with the downstream side cursor 75. Then, the downstream side cursor 75 is moved upstream until the trailing edge of the sheet comes into contact with the upstream side cursor 67. Thereby, the first sheet is aligned by the upstream side cursor 67 and the downstream side cursor 75 in the conveyance direction Y1.

Next, the width alignment members 81U and 81D are moved along the width direction so as to come into contact with both the side edges of the first sheet. Thereby, the first sheet is aligned in the width direction. After the alignment of the sheet, the downstream side cursor 75 is returned to the receiving position and the width alignment members 81U and 81D are returned to the waiting position.

After that, the second is fed from the carrying path 45 by the carrying rollers pair 61. The second sheet is conveyed on the first sheet by the two conveying members 83U and 83D toward the downstream side cursor 75. Then, the downstream side cursor 75 is moved upstream to transport the first and second sheets until the trailing edges of the two sheets come into contact with the upstream side cursor 67. Next, the width alignment members 81U and 81D are moved along the width direction so as to come into contact with both the side edges of the two sheets. The alignment in the conveyance direction Y by the downstream side cursor 75 and the upstream side cursor 67 and the alignment in the width direction by the width alignment members 81U and 81D are performed every one sheet.

Then, after a predetermined number of the sheets (for example, 20 sheets) are fed through the carrying path 45, the sheet stack is formed on the processing tray 47.

The sheet stack is transported to the binding part 49 by the upstream side cursor 67 and the downstream side cursor 75, and the center portion of the sheet stack is bound by the binding part 49. Then, the sheet stack whose center portion is bound is transported along the processing tray 47 to a folding position by the upstream side cursor 67 and the downstream side cursor 75. That is, the upstream side cursor 67 and the downstream side cursor 75 are moved downstream together until the center portion of the sheet stack in the conveyance direction Y1 is positioned at the folding position of the folding part (a position corresponding to the nip N between the folding rollers 91).

At the folding position, the folding blade 93 is driven by the drive mechanism to advance through the interval D into the nip N between the folding rollers 91. Thereby, the center portion of the sheet stack is pushed up into the nip N by the folding blade 93, and the sheet stack is pressed from both the sides by the upstream side roller and the downstream side roller to be folded. As a result, a booklet is produced. The downstream side roller is displaced against the biasing force by the thickness of the folded sheet stack.

The folding blade 93 retracts at a suitable timing, and the upstream and downstream side rollers of the folding roller 101 are further rotated. Then, the booklet is discharged from the nip N to the discharge path 97 of the discharge part 53 with the folded center portion forward.

The booklet discharged to the discharge path 97 is discharged through the third discharge port 11 by the discharge roller 99. The discharged booklet is fallen on the conveyance part 101 of the sheet stacking device 17.

Figure 7:
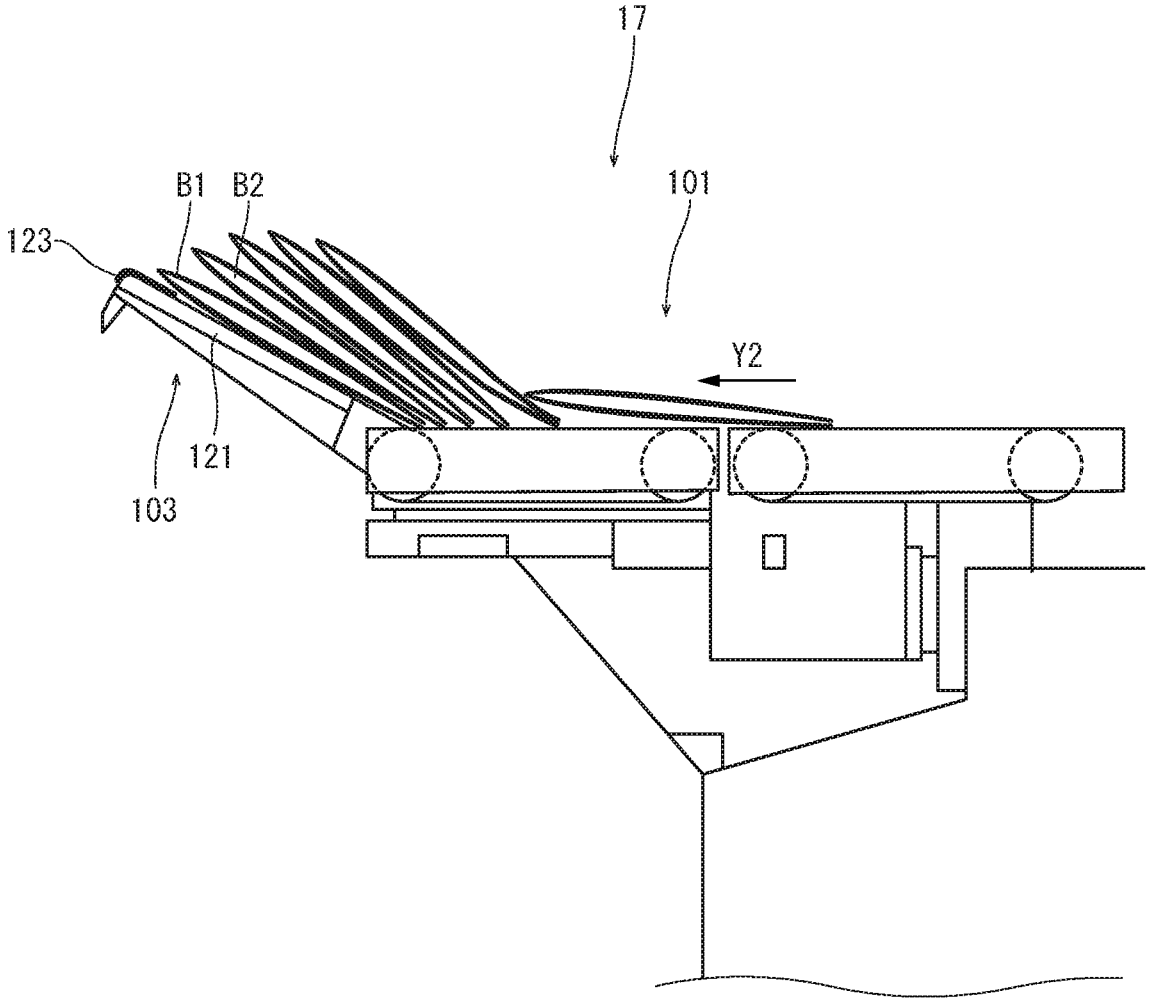
FIG. 7 is a front view showing the sheet stacking device during the conveyance of the booklets, in the post-processing device according to the embodiment of the present disclosure.
Figure 8:
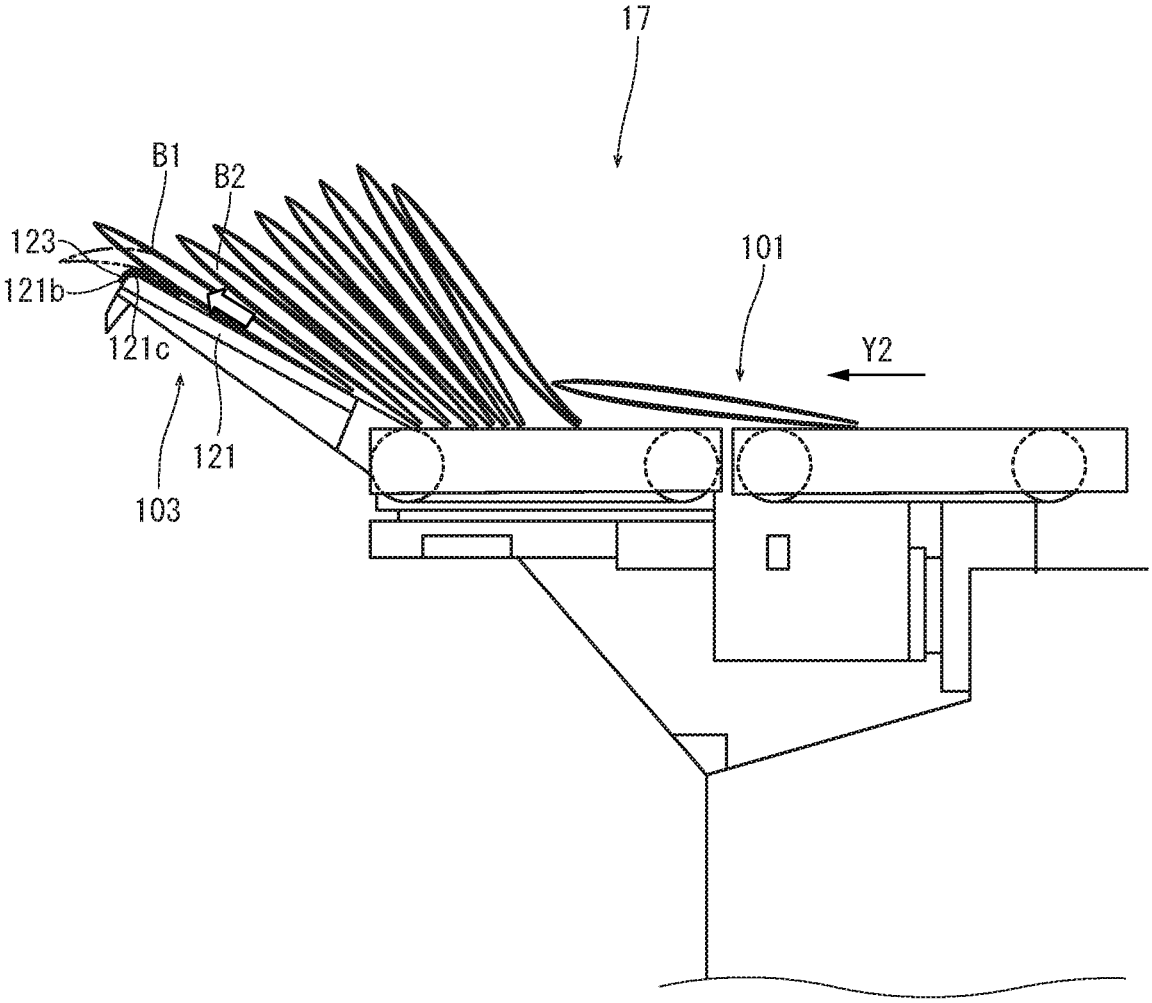
FIG. 8 is a front view showing the sheet stacking device during the conveyance of the booklets, in the post-processing device according to the embodiment of the present disclosure.

An operation for conveying and stacking of the booklet by the sheet stacking device 17 will be described with reference to FIG. 4, FIG. 7 and FIG. 8. FIG. 7 and FIG. 8 are front views showing the sheet stacking device.

The first booklet B1 discharged from the folding device is stacked on the tray 111 of the upstream side conveyance mechanism 107 of the conveyance part 101 of the sheet stacking device 17. Then, the endless belts 117 of the upstream side conveyance mechanism 107 and the downstream side conveyance mechanism 109 are driven to convey the first booklet B1 on the tray 111 along the discharge direction Y2 with the folded center portion forward. The endless belts 117 of each conveyance mechanism is stopped after being driven for a predetermined period. Thus, the first booklet B1 is conveyed for a predetermined distance.

Next, the endless belts 117 of each conveyance mechanism are driven at a timing where the second booklet B2 is stacked on the tray 11 of the upstream side conveyance mechanism 107, and then stopped after being driven for the predetermined period. Thus, the second booklet B2 is stacked on a position displaced from the first booklet B1 for the predetermined distance and then conveyed for the predetermined distance. When the above operation is repeated, the booklets are stacked on the tray 111 of each conveyance mechanism at the predetermined intervals.

When the first booklet B1 reaches the downstream side end portion of the tray 111 of the downstream side conveyance mechanism 109, the actuator 119 is pushed down by the first booklet B1 to be turned from the protruding position to the retracting position. Then, it is detected that the first booklet is conveyed to the predetermined position.

When the first booklet reaches the downstream side end of the conveyance part 101, the leading end portion (the downstream side end portion) of the booklet B1 runs on the stopper 103. During this time, the conveyance part 101 is driven so that the booklet B1 runs on the contact face 121*a* of the main plate 121 completely and is held on the contact face 121*a*. In other words, when the booklet B1 runs on the stopper 103, the conveyance of the booklet B1 by the conveyance part 101 is inhibited. The booklet B1 runs on the stopper 103 while guided along the ribs 131, and therefore smoothly runs on the contact face 121*a*.

The second booklet B2 discharged next is conveyed in the same manner as the first booklet B1. When the second booklet B2 reaches the downstream side end of the conveyance part 101, the leading end portion (the downstream side end portion) of the second booklet B2 runs on the first booklet B1 held on the stopper 103. Because the conveyance part 101 is driven during this time, as shown in FIG. 7, the second booklet B2 runs on the first booklet B1 so as to be stacked on the first booklet B1.

When the booklets are continuously conveyed in the above manner, the booklets B are aligned so as to gradually stand in a vertical posture and to be stacked on the tray 111 of each conveyance mechanism. Then, after the first booklet is conveyed to the predetermined position (after the actuator 119 is turned and then it is detected that the first booklet B1 is conveyed to the predetermined position), at a timing when a predetermined number of booklets are stacked, it is determined that the tray 111 of each conveyance mechanism is full of the booklets. When the full state is determined, the driving of the endless belt 117 of each conveyance mechanism is stopped. Thus, the booklets are prevented from falling from the conveyance part 101. The timing when the full state is determined depends on a size of the sheet and the number of sheets contained the sheet stack.

However, in a case where the full state is determined by the number of booklets as described above, depending on the sheet property (for example, a thickness or a stiffness of the sheet) and the folding state, there is a case where even if the number of booklets is less than the number of booklet determined to be the full state, the conveyance part 101 becomes full of the booklets. In such a case, the first booklet B1 is pushed out downstream from the stopper 103 by the booklet discharged later. Then, the first booklet B1 slides along the ribs 131 of the main plate 121, and then reaches the anti-slip members 123. Because a frictional force between the anti-slip member 123 and the booklet is larger than a frictional force between the main plate 121 (the contact face 121*a*) and the booklet, as shown in FIG. 8, the first booklet B1 is prevented from being pushed out by the anti-slip members 123. That is, the first booklet B1 does not fall from the main plate 121. As shown in a two-dotted chain line in FIG. 8, even if the leading end portion of the booklet B1 is pushed out along the upper corner 121C of the main plate 121, the anti-slip members 123 adhered on the corner 121*c* and the bent face 121*b* of the main plate 121 prevent the booklet B1 from falling.

Alternatively, in some cases, the second booklet B2 may be pushed up along the first booklet B1. In this case, even if the second booklet B2 is pushed out from the stopper 103, the anti-slip members 123 is brought into contact with the second booklet B2 so that the falling of the booklet B2 is prevented.

In a case where the number of the booklets is relatively small, the booklets are blocked by the stopper 103 as described above, and then stacked on the conveyance part 101. However, in a case where the number of the booklets is relatively large, the stopper 103 is turned from the restricting position to the retracting position (refer to the two-dotted chain line in FIG. 4). Then, a collection box 141 (a collection part) is placed below the downstream side conveyance mechanism 109. Thus, the booklet conveyed by the conveyance part 101 is fallen from the downstream side conveyance mechanism 109 and collected into the collection box 141.

As described above, according to the sheet stacking device 17 of the present disclosure, in a case where the booklet discharged earlier is pushed out by the booklet discharged later, the anti-slip members 123 prevent the booklet from falling. Because the anti-slip member 123 is adhered on the upper corner of the main plate 121, in detail, the contact face 121*a* except the ribs 131, the bent face 121*b* and the corner 121*c* between the contact face 121*a* and the bent face 121*b*, it becomes possible to increase an area where the anti-slip member 123 comes into contact with the booklet. Accordingly, it becomes possible to stack the booklets on the conveyance part 10 stably. The anti-slip member 123 is made of inexpensive material such as felt. Additionally, the anti-slip member 123 can be attached easily by an easy working, such as a work for adhering the anti-slip member 123 to the contact face 121*a* and the bent face 121*b* of the main plate 121. Therefore, the means for decreasing the conveyance force of the conveyance part, as described in the above techniques, is not required.

Additionally, because the upper faces of the anti-slip members 123 are lower than the upper faces of the ribs 131, the leading edge of the booklet is not caught by the anti-slip members 123. Furthermore, the upstream side end portion 123*u* of the anti-slip member 123 is disposed upstream the downstream side end portion of the ribs 31 so that the leading edge of the booklet is not caught by the anti-slip members 123. Accordingly, it becomes possible to guide the booklet smoothly along the ribs 131.

Additionally, the downstream side end portion 123*d* of the anti-slip member 123 is covered with the base portion 135*a* and the tip portion 135*b* of the cover part 135 so that the downstream side end portion 123*d* is prevented from being peeled.

Additionally, the stopper 103 is supported in a turnable manner in the restricting position and the retracting position. When the number of the booklets is relatively small and the stopper 103 is turned to the restricting position, it becomes possible to stack the booklets on the conveyance part 101 without using a collection box. On the other hand, when the number of the booklet is relatively large and the stopper 103 is turned to the retracting position, it becomes possible to collect the booklets directly in the collection box 141 from the conveyance part 101 without interfering with the stopper 103.

Furthermore, it becomes possible to couple the post-processing device 1 of the present embodiment to an electrophotographic type or an inkjet type image forming apparats and to produce a booklet using the sheet on which an image is formed by the image forming apparatus. Alternatively, it becomes possible to receive the sheet on which the image is formed by means other than the image forming apparatus. The sheet stacking device 17 of the present disclosure may be applied to a sheet stacking device of the conventional printer.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A sheet stacking device comprising:

a conveyance part including a tray on which sheet stacks discharged from a discharge part at predetermined time intervals are stacked, and a conveyance member which conveys the sheet stack on the tray along a predetermined conveyance direction; and a stopper provided on a downstream side of the tray in the conveyance direction and preventing the sheet stack from falling from the tray, wherein the stopper has:

a main plate inclined upward toward the downstream side with respect to the tray, the main plate having a contact face coming into contact with the sheet stack and a bent face bent downward from a tip end on the downstream side of the contact face so as to retract from the contact face; and at least one anti-slip member provided from a downstream side end portion of the contact face to the bent face and having a frictional coefficient with the sheet stack larger than the contact face, wherein the at least one anti-slip member includes two anti-slip members, and the two anti-slip members are disposed at both end portions of the stopper in a width direction perpendicular to the conveyance direction, and the main plate has a plurality of ribs protruding upward from the contact face and extending along the conveyance direction at intervals in the width direction, and an upper face of the anti-slip member is lower than an upper face of the plurality of ribs.

2. The sheet stacking device according to claim 1, wherein the two anti-slip members are disposed outside the plurality of ribs in the width direction, downstream side end portions of the plurality of ribs are disposed upstream of the bent face in the conveyance direction, and upstream side end portions of the two anti-slip members are disposed upstream of the downstream side end portions of the plurality of ribs in the conveyance direction.

3. The sheet stacking device according to claim 1, wherein the bent face has two cover part each having a base portion and a tip portion, the base portion being stood perpendicular to the bent face and a tip portion being bent upward at right angles from a tip end of the base portion, and the two cover parts cover downstream end portions of the two anti-slip members with the base portions and the tip portions.

4. The sheet stacking device according to claim 1, wherein a frictional coefficient of the anti-slip member with the sheet stack is larger than a fictional coefficient between the sheet stacks.

5. The sheet stacking device according to claim 1, further comprising a collection part disposed below a downstream side end portion of the tray and collecting the sheet stack, wherein the stopper is supported in a turnable manner between a restricting position where the stopper is inclined upward toward the downstream side from the downstream side end portion of the tray and a retracting position where the stopper is turned below the tray and retracts from the tray, and the sheet stack is collected in the collection part in a state where the stopper is turned in the retracting position.

6. The sheet stacking device according to claim 5, wherein an inclined angle of the stopper with respect to the tray can be selectively set.

7. The sheet stacking device according to claim 1, wherein the conveyance member includes an endless belt circulating on the tray to convey the sheet stack, and the sheet stacks are discharged on the tray by the discharge part at the predetermined time intervals and conveyed by the endless belt, whereby the sheet stacks are stacked on the tray at predetermined distance intervals in the conveyance direction.

8. The sheet stacking device according to claim 1, further comprising a detection part disposed at a downstream side end portion of the tray and detecting that the tray is full of the sheet stacks stacked on the tray, wherein after the detection part detects full of the sheet stacks, the conveyance part is stopped.

9. A post-processing device comprising:

a binding part binding a sheet stack;

a folding part folding the sheet stack bound by the binding part; and the sheet stacking device according to claim 1, on which the sheet stack folded by the folding part is stacked.

10. A sheet stacking device comprising:

a conveyance part including a tray on which sheet stacks discharged from a discharge part at predetermined time intervals are stacked, and a conveyance member which conveys the sheet stack on the tray along a predetermined conveyance direction; and a stopper provided on a downstream side of the tray in the conveyance direction and preventing the sheet stack from falling from the tray, wherein the stopper has:

a main plate inclined upward toward the downstream side with respect to the tray, the main plate having a contact face coming into contact with the sheet stack and a bent face bent downward from a tip end on the downstream side of the contact face so as to retract from the contact face; and at least one anti-slip member provided from a downstream side end portion of the contact face to the bent face and having a frictional coefficient with the sheet stack larger than the contact face, and the at least one anti-slip member is adhered along the contact face and the bent face.

* * * * *